US005738568A

United States Patent [19]

Jurjevic et al.

[11] Patent Number: 5,738,568

[45] Date of Patent: Apr. 14, 1998

[54] FLEXIBLE TILTED WAFER CARRIER

[75] Inventors: Robert A. Jurjevic, Williston; Richard J. Lebel, Colchester; Matthew K. Miller, Burlington, all of Vt.

[73] Assignee: International Business Machines Corporation, Armonk, N.Y.

[21] Appl. No.: 726,103

[22] Filed: Oct. 4, 1996

[51] Int. Cl.[6] ..... B24B 1/00

[52] U.S. Cl. ..... 451/41; 451/287; 451/288; 451/405

[58] Field of Search ..... 451/41, 285, 287, 451/288, 398, 405, 387

[56] References Cited

U.S. PATENT DOCUMENTS

| | | | |
|---|---|---|---|
| 3,570,188 | 3/1971 | Ebner | 451/288 |
| 4,020,600 | 5/1977 | Day . | |
| 4,270,316 | 6/1981 | Kramer et al. . | |
| 5,036,630 | 8/1991 | Kaanta et al. . | |
| 5,055,425 | 10/1991 | Leibovitz et al. . | |
| 5,069,002 | 12/1991 | Sandhu et al. | 451/287 |
| 5,081,795 | 1/1992 | Tanaka et al. . | |
| 5,197,230 | 3/1993 | Simpfendorfer et al. | 451/287 |
| 5,297,361 | 3/1994 | Baldy et al. . | |
| 5,399,528 | 3/1995 | Leibovitz et al. . | |
| 5,423,716 | 6/1995 | Strasbaugh | 451/287 |
| 5,476,414 | 12/1995 | Hirose et al. . | |
| 5,562,529 | 10/1996 | Kishii et al. | 451/287 |

*Primary Examiner*—Eileen P. Morgan

*Attorney, Agent, or Firm*—Schmeiser, Olsen & Watts; Howard J. Walter, Jr.

[57] ABSTRACT

Disclosed is an improved apparatus and method for polishing a semiconductor wafer, which involves mounting the wafer to a carrier assembly. The wafer carrier assembly has been split into two plates which are joined by springs around the peripheries. The wafer carrier assembly is universally mounted on a rotation shaft which rotates the wafer carrier assembly during cleaning. An adjustment screw tilts the upper plate relative to the lower plate. The adjustment screw can be located at any predetermined point on a circle around the rotation shaft. Since the bottom plate is forced relatively flat by contact with a polishing pad, the net effect of the wafer carrier assembly is to apply increased pressure to the wafer edge under the screw. This provides for an even polishing action to compensate for otherwise non-uniform radial polishing action on the wafer surface.

23 Claims, 1 Drawing Sheet

FLEXIBLE TILTED WAFER CARRIER

BACKGROUND OF THE INVENTION

1. Technical Field

The present invention relates to a polishing apparatus for polishing the surface of a workpiece. The invention utilizes relative movement between the workpiece and a polishing (or cleaning) pad, while pressing the two together. More particularly, the invention is directed to a polishing apparatus for polishing silicon wafers, or other thin highly finished materials, with high accuracy.

2. Background Art

Rapid progress in semiconductor device integration demands smaller and smaller wiring patterns or interconnections which connect active areas. As a result, the tolerances regarding the planeness or flatness of the semiconductor wafers used in these processes are becoming smaller and smaller. One customary way of flattening the surfaces of semiconductor wafers is to polish them with a polishing apparatus.

Such a polishing apparatus has a rotating wafer carrier assembly in contact with a polishing pad. The polishing pad is mounted on a rotating turntable which is driven by an external driving force. The polishing apparatus causes a polishing or rubbing movement between the underside of each thin semiconductor wafer and the polishing pad while dispersing a polishing agent. The polishing agent contains abrasive grains so that the surface of the thin semiconductor wafer is polished at high accuracy based on a chemical mechanical polish (CMP) operation (a combination of mechanical polishing and chemical polishing).

The leading edge of the wafer carrier assembly is where the large polishing surface of the polishing pad meets the wafer surface. The trailing edge of the wafer carrier assembly is located on the opposite side of the leading edge on the wafer carrier assembly. The wafer carrier assembly can be gimbaled or balanced about an axis so that the leading edge of the wafer carrier assembly can accept the contour of the polishing pad and maintain a level wafer cleaning surface with the polishing pad.

An example of a wafer carrier assembly is disclosed in U.S. Pat. No. 5,081,795 issued to Tanaka et al. on Jan. 21, 1992 and assigned to Shin-Etsu Handotai Co., Ltd. This patent discloses a complex wafer carrier design which gimbals the wafer assembly carrier and uses two thin holding means to hold the carrier assembly. However, this type of wafer carrier assembly would require a lot of engineering attention to perform correctly and the tolerances would have to be almost exact. The aforementioned art is hereby incorporated by reference.

SUMMARY OF THE INVENTION

Although a wafer carrier assembly is gimbaled we discovered that there still exists non-uniform polishing problems. We found that frictional resistance between the underside of the wafer and the polishing pad can cause the wafer carrier assembly to be tilted downward at its leading edge. As a result, the wafer carrier assembly digs into the polishing pad rather than skidding into the polishing pad. The overall effect is that the wafer is not held flat on the polishing pad and the proper pressure is not applied to the leading edge versus the trailing edge of the wafer. This can lead to removal at the edge of the wafer being different from that in the center.

In order to ensure high performance, we discovered that it is critical that the wafer carrier assembly not only be able to gimbal at an axis point, but gimbal at a set attack angle. To overcome the problems caused by frictional forces, waviness of the polishing pad, uneven polishing pad conditioning, and beating and gimbal wear, we found that the operator needs to be able to apply an adjustable downward force on the trailing edge side of the wafer carrier assembly (or other edges of the wafer carrier assembly depending on the problem to be overcome).

The present invention provides a polishing apparatus for polishing the surface of a workpiece which can execute a polishing work which can easily follow even slight surface displacement, but will also prevent the build up of friction forces under the pad.

According to the present invention, there is provided a polishing apparatus for polishing a surface of a workpiece which comprises a first plate for holding the workpiece on a lower surface of the first plate, vibration dampening devices (or system) which connect an upper surface of the first plate to the lower surface of a second plate, the second plate pivotally mounted to a universally rotatable shaft, and a means for tilting the second plate relative to the first plate. The vibration dampening devices may comprise springs or other shock absorbing material. The tilting means may be an adjustment screw.

In accordance with the above, it is an advantage of the present invention to provide a polishing apparatus which prevents non-uniform polishing of a wafer surface.

It is a further advantage of the present invention to provide a polishing apparatus where the angle of attack of the wafer carrier assembly can be adjusted simply and reliably.

It is a further advantage of the present invention to provide a wafer carrier where the vibration dampening devices may be provided on the periphery of the wafer carrier assembly or at another location.

It is a further advantage of the present invention that the adjustment screw can be manually adjusted.

It is a further advantage of the present invention that the adjustment screw can be monitored by a pressure gauge.

It is a further advantage of the present invention that the adjustment screw setting can be controlled by a feedback loop tied to a computer.

It is a further advantage of the present invention that the second plate is universally mounted to the rotatable shaft.

It is a further advantage of the present invention that the location of the adjustment screw can be changed to any point at 360 degrees around the rotating shaft.

It is a further advantage of the present invention to have a swivel wheel attached to the bottom of the adjustment screw.

It is a further advantage of the present invention to provide a polishing apparatus which is reliable and easily maintainable.

It is a further advantage of the present invention to provide a polishing apparatus which is able to be cheaply and easily tunable.

The foregoing and other objects, features and advantages of the invention will be apparent from the following more particular description of the Preferred Embodiments of the Invention, as illustrated in the accompanying drawings.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the sizes of constituting components, the materials thereof, the shapes thereof, the relative arrangement thereof, etc., and are disclosed simply as an example of the embodiment.

Figure 1:
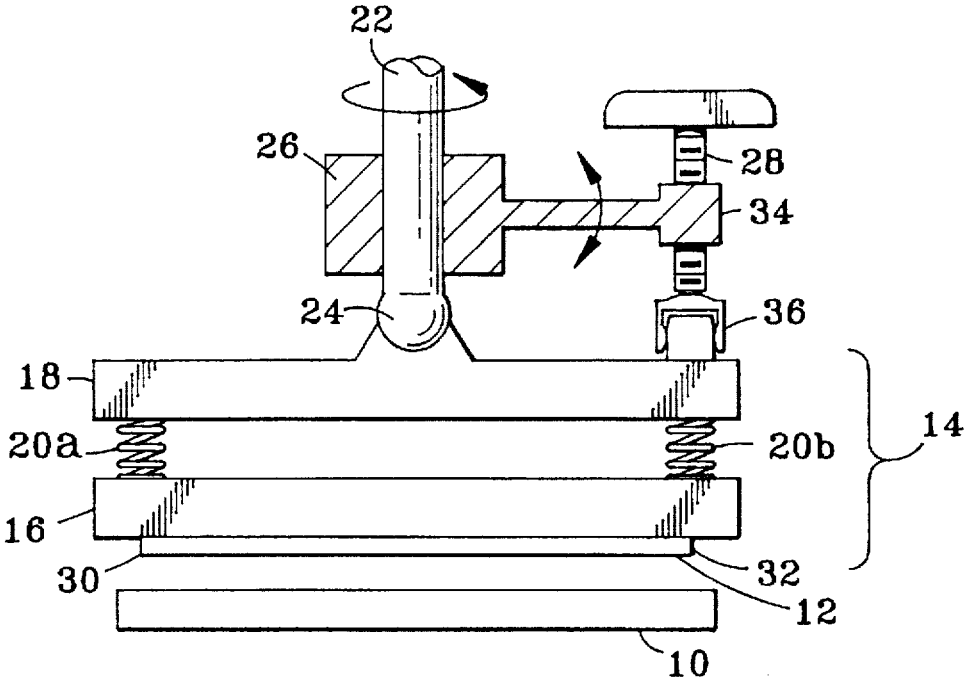
FIG. 1 depicts a portion of a polishing apparatus in accordance with a preferred embodiment of the invention.

FIG. 1 illustrates the structure of the essential portions of a polishing apparatus or machine according to a first embodiment of the invention. Reference numeral 10 denotes a polishing pad which is attached to a rotating turntable surface which is not shown. The polishing pad 10 is covered with an abrasive polishing slurry. Reference numeral 12 shows an example of a workpiece to be polished such as a semiconductor wafer.

The wafer carrier assembly 14 is an example of at least one wafer carrier assembly which can be supported above the polishing pad 10. The carrier assembly 14 is split into a lower first plate 16 and an upper second plate 18. The wafer 12 is attached to the lower surface of the first plate 16. The two plates are interconnected by a vibration dampening mechanism or system. The vibration dampening devices **20*a* and 20*b* extend between the plates. These vibration dampening devices 20*a*,20*b* can be springs or other shock absorbing type material. While FIG. 1** shows two springs, it is recognized that any number of springs may be used. The vibration dampening devices are shown mounted on the periphery of the plates, but are not limited in location to those portions of the plates.

The upper second plate 18 is attached to a rotation shaft 22 which turns the carrier assembly 14 at high rotating speeds. The carrier assembly 14 is universally mounted on the rotation shaft end 24 which forms a ball which acts as a gimbal point. Surrounding the rotation shaft 22 is a rotation bearing assembly 26 which extends from the rotation shaft 22 to an adjustment screw 28. The section of the rotation bearing assembly 26 which is coupled to the adjustment screw 28 is designated as the adjustment screw collar 34. Although the rotation bearing assembly 26 surrounds the rotation shaft 22, it is not turned by the rotation shaft 22. The position of the rotation bearing assembly 26 is independently adjustable by the operator.

The adjustment screw 28 provides a means for tilting the upper second plate 18 relative to the lower first plate 16. The adjustment screw 28 applies a downward force on the upper second plate 18 which then applies a force on the spring **20*b*. The spring 20*b* then applies a downward force to the first plate 18 on the trailing edge 32. Since the lower first plate 16 is forced relatively flat by contact with the polishing pad 10, the net effect is to apply increased pressure to the wafer edge under the adjustment screw 28. The adjustment screw 28 provides a downward force on the trailing edge side of the wafer 12 which counteracts the frictional forces which are causing the wafer carrier assembly 14 to dig into the polishing pad 10. The adjustment screw 28 allows the operator to set a predetermined angle of attack (or polishing angle) of the rotating wafer carrier assembly 14 onto the rotating polishing pad 10 by increasing or decreasing the pressure on the upper second plate 18. Therefore, the adjustment screw 28 ensures that the wafer carrier assembly 14 is able to gimbal and follow the contour of the polishing pad 10, but will also allow the operator to compensate for the buildup of frictional forces which cause the wafer carrier assembly 14 to dig into the pad 10. The overall effect is to make sure that the proper pressure is applied to the leading edge 30 versus the trailing edge 32 of the wafer 12** in reference to the relative polishing pad rotation and obtain a uniform cleaning of the wafer surface.

Although the adjustment screw 28 can be used to put force on the trailing edge side of the wafer carrier assembly 14, it can be also be used to locate the downward force on the wafer carrier assembly 14 at any predetermined point on the surface of the upper second plate 18 to prevent the upward movement of one edge of the wafer carrier assembly 10. The adjustment screw collar 34 is mounted to the bearing assembly 26 so as to be able to tilt the wafer 12 at any point radially between the leading edge 30 and trailing edge 32, thus taking into account for radially induced variations due to polishing pad 10 and wafer 12 rotations. The position of the adjustment screw 28 can be changed to any point at 360 degrees around the rotating shaft 22 and may apply a downward force at any predetermined point on that circle. To facilitate this movement, the adjustment screw 28 may include a swivel wheel 36 attached to the bottom and in contact with the upper surface of the second plate 18.

Figure 2:
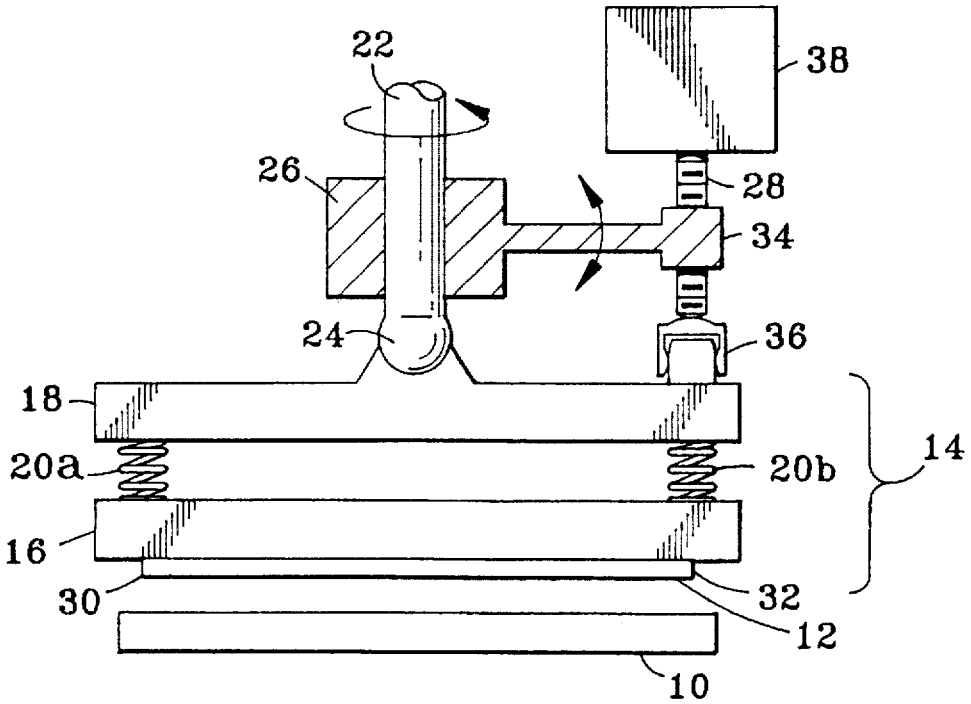
FIG. 2 depicts an alternate embodiment of the invention showing the wafer carrier assembly connected to an alternative adjustment device.

In FIG. 1, the adjustment screw 28 is shown to be a simple hand screw which is set manually by the operator for the desired attack angle. The adjustment screw 28 could also be adjusted by an alternate adjustment device (designated 38 in FIG. 2). For example, the alternative adjustment device may include a system to monitor and control the adjustment screw with a pressure gauge or a feedback loop tied to a computer.

What is claimed is:

1. A polishing apparatus for polishing a surface of a workpiece comprising:

a carrier assembly which is pivotally mounted to a rotation shaft; and tilting means for setting a polishing angle on the carrier assembly by applying pressure to a predetermined point on said carrier assembly, said tilting means being rotationally positionable 360 degrees around said rotation shaft.

2. The polishing apparatus according to claim 1, wherein the tilting means limits the upward movement of an edge of the carrier assembly.

3. The polishing apparatus according to claim 1, wherein the tilting means is coupled to a bearing which surrounds the rotation shaft.

4. The polishing apparatus according to claim 1, wherein the tilting means includes an adjustment screw.

5. The polishing apparatus according to claim 4, wherein the adjustment screw has a swivel wheel attached thereto.

6. The polishing apparatus according to claim 1, wherein the carrier assembly includes a first lower plate; and a second upper plate which are connected with vibration dampening devices.

7. The polishing apparatus according to claim 6, wherein the vibration dampening devices comprise a plurality of springs.

8. The polishing apparatus according to claim 4, wherein the adjustment screw is a hand screw.

9. The polishing apparatus according to claim 1, wherein the tilting means is controlled by a pressure gauge.

10. The polishing apparatus according to claim 1, wherein the tilting means is controlled by a feedback loop.

11. A polishing apparatus for polishing a surface of a workpiece comprising:

a carrier assembly including a first plate, said first plate having a lower surface wherein said workpiece may be held, and a second plate positioned above said first plate;

a rotatable shaft wherein said second plate is pivotally mounted thereto;

a vibration dampening system interconnecting an upper surface of said first plate to a lower surface of said second plate; and means for tilting said second plate relative to the first plate, wherein said titling means is rotationally mounted to said rotatable shaft.

12. The polishing apparatus according to claim 11, wherein said vibration dampening system comprises a plurality of springs.

13. The polishing apparatus according to claim 11, wherein the tilting means includes an adjustment screw.

14. The polishing apparatus according to claim 11, wherein the workpiece is a semiconductor wafer.

15. The polishing apparatus according to claim 12, wherein said plurality of springs are located peripherally on the first and second plates.

16. The polishing apparatus according to claim 13, wherein the adjustment screw is a hand screw.

17. The polishing apparatus according to claim 11, wherein the tilting means is controlled by a pressure gauge.

18. The polishing apparatus according to claim 11, wherein the tilting means is controlled by a feedback loop.

19. The polishing apparatus according to claim 11, and further comprising a bearing which surrounds the rotatable shaft and which is coupled around the adjustment screw.

20. The polishing apparatus according to claim 13, and further comprising a swivel wheel attached to the adjustment screw.

21. A method of polishing a surface of a workpiece with a polishing apparatus having a carrier assembly, a device for tilting said carrier assembly, and a rotation shaft, wherein said carrier assembly is pivotally mounted to said rotation shaft, and said tilting device is rotationally positionable around said rotation shaft, said method comprising the steps of:

a) mounting said workpiece on a lower surface of said carrier assembly;

b) positioning said tilting device at a predetermined position on a top surface of the carrier assembly;

c) adjusting said tilting device to create a predetermined angle of attack of the carrier assembly; and d) rotatably contacting the workpiece with a rotating polishing pad to effect a polishing action across the workpiece.

22. The method of claim 21, wherein said tilting device includes an adjustment screw.

23. The method of claim 21, wherein said carrier assembly comprises a lower first plate which is interconnected with an upper second plate through a vibration dampening system.

* * * * *